US009185951B2

(12) United States Patent
Keyaki et al.

(10) Patent No.: US 9,185,951 B2
(45) Date of Patent: Nov. 17, 2015

(54) VERTICALLY ENGAGING SLIDER FOR SLIDE FASTENER

(75) Inventors: Keiichi Keyaki, Toyama (JP); Yuichi Iwase, Toyama (JP)

(73) Assignee: YKK Corporation (JP)

( * ) Notice: Subject to any disclaimer, the term of this patent is extended or adjusted under 35 U.S.C. 154(b) by 282 days.

(21) Appl. No.: 14/112,309

(22) PCT Filed: Apr. 18, 2011

(86) PCT No.: PCT/JP2011/059559

§ 371 (c)(1),
(2), (4) Date: Oct. 17, 2013

(87) PCT Pub. No.: WO2012/144003

PCT Pub. Date: Oct. 26, 2012

(65) Prior Publication Data

US 2014/0041162 A1 Feb. 13, 2014

(51) Int. Cl.
*A44B 19/26* (2006.01)
*A44B 19/04* (2006.01)

(52) U.S. Cl.
CPC ..... *A44B 19/26* (2013.01); *A44B 19/04* (2013.01); *Y10T 24/2539* (2015.01); *Y10T 24/2582* (2015.01)

(58) Field of Classification Search
CPC ..... A44B 19/24; A44B 19/62; A44B 19/26; Y10T 24/2563; Y10T 24/2564; Y10T 24/258; Y10T 24/2582
See application file for complete search history.

(56) References Cited

U.S. PATENT DOCUMENTS

| | | | | |
|---|---|---|---|---|
| 2,077,350 | A * | 4/1937 | Sundback | 24/427 |
| 2,273,732 | A * | 2/1942 | Quisling | 24/427 |
| 2,415,643 | A | 2/1947 | Legat | |
| 4,199,845 | A * | 4/1980 | Ausnit | 24/427 |
| 6,594,873 | B2 * | 7/2003 | Argento | 24/416 |
| 6,604,262 | B2 | 8/2003 | Wang | |
| 2003/0033695 | A1 | 2/2003 | Wang | |
| 2009/0165266 | A1 | 7/2009 | Deto | |

FOREIGN PATENT DOCUMENTS

| | | | |
|---|---|---|---|
| JP | 1958-004133 | U | 3/1958 |
| JP | 1974-073250 | A | 7/1974 |
| JP | 2000-139521 | A | 5/2000 |
| JP | 2003-38214 | A | 2/2003 |
| JP | 2005-152023 | A | 6/2005 |

OTHER PUBLICATIONS

Office Action, Japanese Patent Application No. 2013-510755, mailed Sep. 30, 2014.
International Preliminary Report on Patentability, PCT Application No. PCT/JP2011/059559 mailed Nov. 5, 2013.
International Search Report, PCT Application No. PCT/JP2011/059559 mailed May 24, 2011.

* cited by examiner

*Primary Examiner* — Robert J Sandy
(74) *Attorney, Agent, or Firm* — Kilpatrick Townsend & Stockton LLP

(57) ABSTRACT

There is provided a vertically engaging slider made of metal, which is suitable for the industrial production. The front end wall of the slider according to the present invention has a plastically deformed portion caused by plastic working in which with the front end wall itself as a fulcrum, the back opening is deformed from an open state to a closed state in the upper-lower direction.

11 Claims, 7 Drawing Sheets

VERTICALLY ENGAGING SLIDER FOR SLIDE FASTENER

This application is a national stage application of PCT/JP2011/059559 which is incorporated herein by reference.

TECHNICAL FIELD

The present invention relates to a vertically engaging slider for a slide fastener. Also, the present invention relates to a slide fastener that comprises the slider.

RELATED ART

The slide fastener is widely used as a tool for opening/closing an article, not only in the daily commodities, such as garments, bags, shoes and sundry articles, but also in the industrious agents, such as a water storage tank, a fishnet and a space outfit.

Typically, the slide fastener is mainly provided with three portions of a pair of elongated fastener tapes, element rows each serving as engaging portions of a fastener attached along one side of each tape and a slider that controls an action for opening and closing the fastener by making the pair of element rows engaged with and separated from each other. The slider has a function that makes the element rows engaged with or separated from each other by sliding the element rows while fitting them therein. The slider that is typically often seen is a horizontally engaging type, and an element guide way of an approximately Y-shape which is branched into left and right directions is formed therein, and the element rows are engaged with or separated from each other by the planar motion in the left-right direction of the element rows.

On the other hand, there is a vertically engaging slider in which the action for making the element rows engaged with and separated from each other is carried out by the vertically cubic motions of the element rows. FIGS. 4 to 6 of the specification in U.S. Pat. No. 2,415,643 disclose a slider which contains an upper wing plate 11 and a lower wing plate 12 and in which the upper wing plate 11 is connected to a pull-tab attaching portion 13 to which a pull-tab 14 is movably attached. The upper wing plate 11 and the lower wing plate 12 are approximately equal in width in their entire longitudinal directions, and in the back portion of the slider, both are arranged substantially parallel to each other. On the other hand, in the front portion of the slider, both are configured to be mutually branched so as to form an approximately Y-shaped space in an upper-lower direction. Also, in order to reduce the friction with the elements to a minimum, a concave portion 16 is formed on the center of the front portion in the slider. Also, on both sides of the slider, grooves for guiding the elements are formed by using the space sandwiched between the upper wing plate 11 and the lower wing plate 12. FIG. 14 of the specification shows that the upper wing plate 11 and the lower wing plate 12 have arched paths 15 and 17 for receiving the loop elements.

Also, the specification of U.S. Pat. No. 6,604,262 describes a three-dimensional fitting fastener that can be applied to an opening/closing unit of a hard article. In a slider 5 used in the three-dimensional fitting fastener, as shown in FIGS. 3, 3*a* and 3*b* of the specification, two inlet ports 51 and 52 formed in different stages in an upper-lower direction are made at a front end, and an arched guide surface 51*a* is formed downwardly from the input port 51 of the upper stage, and an arched guide surface 52*a* is formed upwardly from the input port 52 of the lower stage, respectively. Both of the surfaces 51*a* and 52*a* join each other and serve as a central flat surface 53*a* and extends to a common outlet port 53 formed at the back end of the slider 5. Also, a slit 51*b* that extends downwardly from the input port 51 of the upper stage and a slit 52*b* that extends upwardly from the input port 52 of the lower stage are formed on the side wall of the slider 5, in order to expose a fastener tape.

RELATED ART DOCUMENT

Patent Document 1: U.S. Pat. No. 2,415,643
Patent Document 2: U.S. Pat. No. 6,604,262

SUMMARY OF THE INVENTION

Problems to be Solved by the Invention

In a case that a cloth on which the slide fastener is sewed is strong in rigidity because the cloth is made of thick leather and the like, or in a case that the slide fastener is sewed on the edge of the cloth, namely, the slide fastener is sewed while an interval between a fastener element and a cloth edge is made narrow, a slide resistance of the slider becomes extremely great in a horizontal engaging slider. Thus, in the foregoing case, the drop in the slide resistance is considered to be attained by using the vertically engaging slider. However, when the vertically engaging slider is molded in die-cast, its metallic mold shape becomes complicated, thereby requiring the slide core of three directions or more. With the existence of the slide core that is obliquely fed, it is impossible to increase the number that can be taken out from the metallic mold. Moreover, with the parting of the metallic mold, it is difficult to remove burrs at the time of molding. As mentioned above, there are many programs with regard to an industrial production. There is a case that the slider is made of plastic. However, in many cases, the slider is requested to be made of metal from the viewpoint of its appearance and strength, depending on the article. Therefore, there are the needs for the vertically engaging slider made of the metal.

The present invention has been made in view of the above situations, and one subject of the present invention is to provide a vertically engaging slider made of metal, which is suitable for the industrial production. In addition, another subject of the present invention is to provide a slide fastener that comprises the slider.

Means for Solving the Problems

The present inventors have made intensive studies so as to solve the above-described problems, and have found out that a vertically engaging slider made of metal can be easily produced under an industrial method, by molding a half-finished product of a slider with a back opening opened in the upper-lower direction and then closing the back opening side and consequently obtaining a slider completion product. The present invention completed with the above knowledge as a base will be specified below.

In one aspect, the present invention is a metallic slider for a slide fastener, comprising: an upper wing plate; a lower wing plate; a front end wall connecting the upper wing plate and the lower wing plate and having two front openings which are formed in different stages in the upper-lower direction and through which a pair of separated element rows are to be moved in and out; a back opening through which a pair of fitted element rows to be are moved in and out; and an element guide way which is arranged between the upper wing plate and the lower wing plate and communicates the two front openings with the back opening, wherein the front end wall has a plastically deformed portion caused by plastic working in which with the front end wall itself as a fulcrum, the back opening is deformed to a closed state from an open state in the upper-lower direction.

In one embodiment of the slider according to the present invention, an inner surface of the upper wing plate has a slant surface extending downwardly from the upper front opening and a horizontal surface on which the element rows are to be engaged with each other, the horizontal surface being connected to the downward slant surface, an inner surface of the lower wing plate has a slant surface extending upwardly from the lower front opening and a horizontal surface on which the element rows are to be engaged with each other, the horizontal surface being connected to the slant surface, and back ends of the respective horizontal surfaces are communicated with the back opening.

In another embodiment of the slider according to the present invention, the slider comprises left and right side walls having guide grooves of fastener tapes, respectively, and slant portions and horizontal portions that correspond to the shapes of the inner surface of the upper wing plate and the inner surface of the lower wing plate are formed in the guide grooves.

In still another embodiment of the slider according to the present invention, the plastically deformed portion is a partition portion for separating said two front openings to the upper and lower directions in the front end wall.

In still another embodiment of the slider according to the present invention, each of said two front openings exists so as to straddle a central line in a left-right direction, and whereby said two front openings (107, 108) have an overlapping portion in the left-right direction.

In still another embodiment of the slider according to the present invention, in the overlapping portion between a lower end of the upper front opening and a upper end of the lower front opening, an element guide pole, which has a shape of an approximately isosceles triangle pole having its apex on a back opening side, is formed so as to lay in the left-right direction.

In still another embodiment of the slider according to the present invention, the plastic working is carried out by applying pressure to both outer surfaces of the upper wing plate and the lower wing plate so as to sandwich them.

In still another embodiment of the slider according to the present invention, the outer surfaces of the upper wing plate and the lower wing plate are both flat except pull-tab attaching portion.

In another aspect, the present invention is a slide fastener comprising: a pair of fastener stringers each of which has a fastener tape and a row of elements attached along one side edge of the tape; and the slider according to any one of the above, which makes the rows of the elements engaged with or separated from each other, by sliding while inserting through the rows of the elements.

In one embodiment of the slide fastener according to the present invention, the slide fastener comprises upper stoppers each of which is placed at a front end of each of the rows of the fastener elements and then, a part or whole of the upper stoppers is inserted into the element guide way from the back.

In another embodiment of the slide fastener according to the present invention, the slide fastener comprises an upper stopper that has a front portion having protrusion which can be brought into contact with circumferences of the front openings, and a back portion which is inserted into the element guide way from the front openings.

Effect of the Invention

With regard to the vertically engaging slider made of the metal according to the present invention, after the half-finished product of the slider with the back opening side is opened in the upper-lower direction is molded, the plastic working is conducted thereon so that the back opening side is closed, and the slider completion product is consequently obtained. The half-finished product having the back opening side opened in the upper-lower direction can be easily die-casted. For this reason, the vertically engaging slider made of the metal is suitable for the industrial production. Then, even if the vertically engaging slider made of the metal according to the present invention is applied to the slide fastener used in the thick cloth such as the leather and the like, the opening/closing operation can be carried out under the low slide resistance, and the slide fastener can be formed at a narrow width in the left-right direction. Thus, the slide fastener can be sewed on the edge of the cloth, namely, the slide fastener can be sewed while the interval between the fastener element and the cloth edge is made narrow In the case where the inner surface of the upper wing plate has the slant surface extending downwardly from the upper front opening and the horizontal surface connected to the downward slant surface, on which the element rows are engaged with each other, and the inner surface of the lower wing plate has the slant surface extending upwardly from the lower front opening and the horizontal surface connected to the slant surface, on which the element rows are engaged with each other, and the back ends of the respective horizontal surfaces are communicated with the back opening, the operation for making the element rows engaged with and separated from each other is smoothly carried out, which can improve the sliding property of the slider.

In the case where the slider comprises the left and right side walls having the guide grooves of the fastener tapes, respectively, and slant portions and horizontal portions that correspond to the shapes of the inner surface of the upper wing plate and the inner surface of the lower wing plate are formed, the motions of the fastener tape and the element row are coincident with each other. Thus, the slide property of the slider can be improved.

In the case where the plastically deformed portion is a partition portion for separating said two front openings to the upper and lower directions in the front end wall, the operation for closing the back opening is made easy, which improves the dimensional precision of the slider completion product.

In the case where each of the two front openings exists so as to straddle the central line in the left-right direction and consequently said two front openings has an overlapping portion in the left-right direction, the operation for making the element rows engaged with each other is made smooth. In addition, the width in the left-right direction of the slider can be made narrow.

In the case where, in the overlapping portion between the lower end of the upper front opening and the upper end of the lower front opening, the element guide pole, which branches the element and has the shape of the approximately isosceles triangle pole having its apex on the back opening side, is formed so as to lay in the left-right direction, the element row can be smoothly moved in and out from the element guide way. Therefore, the sliding property of the slider is improved.

In the case where the plastic working is carried out by applying pressure to both outer surfaces of the upper wing plate and the lower wing plate so as to sandwich them, the dimensional precision is improved when the back opening is closed and the slider completion product is obtained.

In the case where both of the outer surfaces of the upper wing plate and the lower wing plate are made flat, when the back opening side is closed, it becomes easier to apply the pressure, which also contributes to the improvement of the dimensional precision.

DESCRIPTION OF EMBODIMENTS

In this specification, when the slide fastener is configured, a slide direction of the slider is defined as a front-back direction, a direction in which the slider is slid to make the element rows engaged with each other is defined as a front direction, and a direction in which the slider is slid to make the element rows separated from each other is defined as a back direction. In addition, a direction vertical to a surface of the fastener tape is defined as an upper-lower direction, a direction to an upper wing plate from a lower wing plate is defined as an upper direction, and a direction to the lower wing plate from the upper wing plate is defined as a lower direction. In addition, a direction that is parallel to the surface of the fastener tape and orthogonal to the slider sliding direction is defined as a left-right direction. Then, when the slider is slid forwardly when the slider is viewed from above, a right side in a travel direction of the slider is defined as a right direction, and a left side in the travel direction is defined as a left direction. In addition, a surface that is parallel to the front-back direction and the left-right direction is defined as a horizontal surface.

In the following, embodiments of the present invention are described below in detail with reference to the drawings.

<1. Slider>

Figure 1:
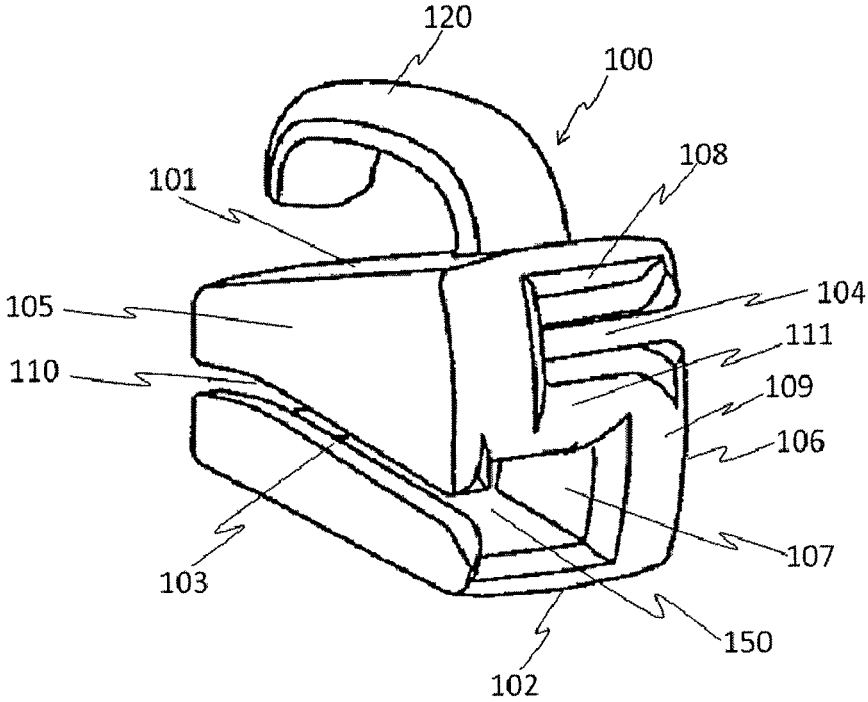
FIG. 1 is a perspective view of a vertically engaging slider according to one embodiment of the present invention.
Figure 2:
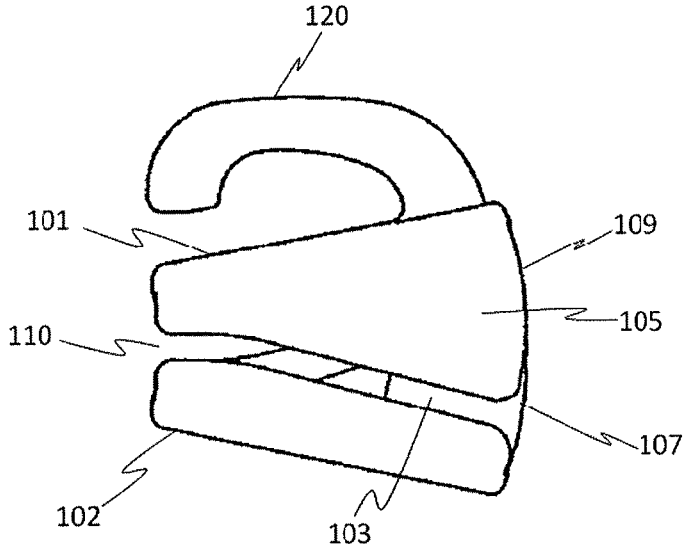
FIG. 2 is a side view of the vertically engaging slider shown in FIG. 1.
Figure 3:
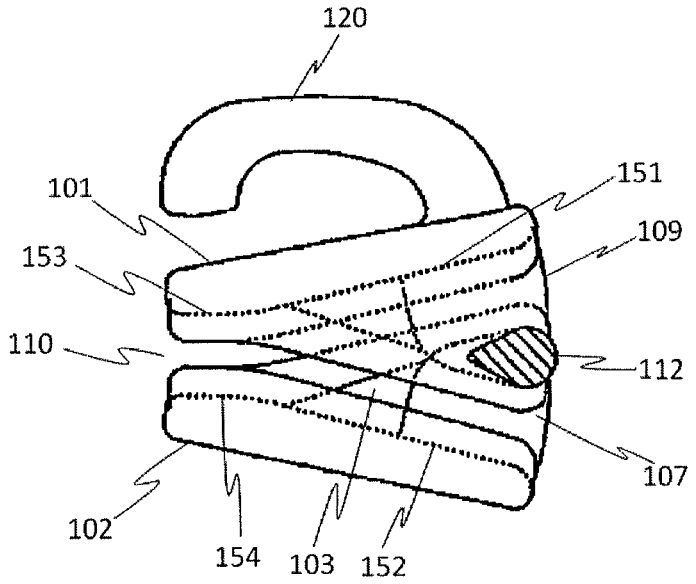
FIG. 3 is a view similar to the side view shown in FIG. 2, in which a portion hidden behind is indicated with dotted lines and which shows a plastically deformed portion with slant lines.
Figure 4:
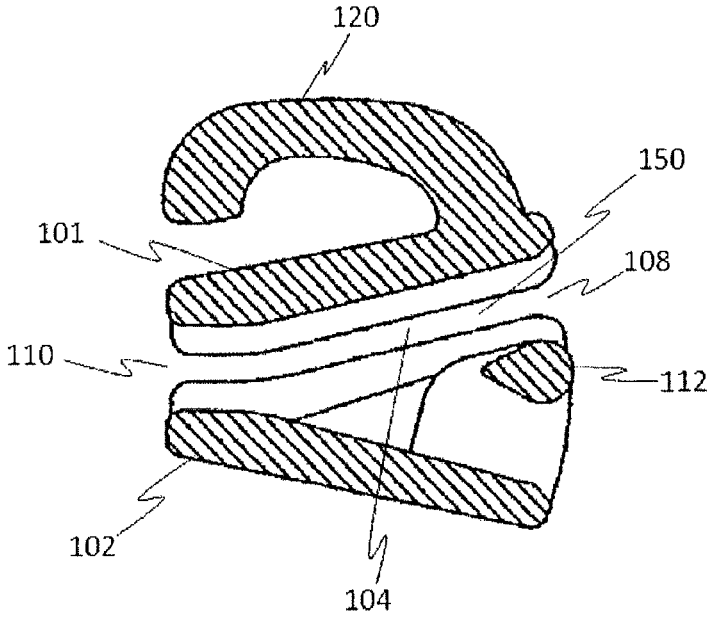
FIG. 4 is a cross-sectional view of the vertically engaging slider shown in FIG. 1, which is cut away with respect to a left-right central line.

FIG. 1 shows the perspective view of the vertically engaging slider according to the embodiment of the present invention. FIG. 2 shows the side view of the vertically engaging slider shown in FIG. 1. FIG. 3 shows the side view shown in FIG. 2, in which the hidden behind portion is indicated with the dotted lines. FIG. 4 shows the cross-sectional view of the vertically engaging slider shown in FIG. 1, which is cut away with respect to the left-right central line The vertically engaging slider according to the present invention is made of metal so that plastic deformation can be performed. The kind of the metal is not particularly limited, and for example, gold, silver, copper, aluminum, tungsten, nickel, zinc, iron, or alloy that contains one or more of the above metals are listed.

With reference to FIG. 1, a slider (100) according to this embodiment comprises, as its basic structure, an upper wing plate (101), a lower wing plate (102), left and right side walls (105, 106) that respectively have guide grooves (103, 104) for the fastener tapes, a front end wall (109) that has two front openings (107, 108) which are formed in different stages in the upper-lower direction and connects the upper wing plate (101) and the lower wing plate (102) and through which a pair of separated element rows move in and out, and one back opening (110) through which the pair of engaged element rows move in and out.

The upper wing plate (101) has a pull-tab attaching portion (120) on its upper surface. In this embodiment, the pull-tab attaching portion (120) is gate-shaped to extend in the slide direction while one end is cantilever-fixed. However, the shape of the pull-tab attaching portion (120) is not limited to the above. It is possible to employ any shape of the pull-tab attaching portion that is known by one skilled in the art. In addition, a pull-tab (201) having an annular portion at its end, which is not shown in FIG. 1, may be prepared and the pull-tab (201) may be rotatably attached to the pull-tab attaching portion (120) through the annular portion (refer to FIG. 6). In addition, the tip of the pull-tab attaching portion (120) is caulked in the lower direction (i.e. the direction approaching the upper wing plate) so that the pull-tab (201) is not easily separated from the pull-tab attaching portion (120).

With reference to FIG. 3, the two front openings (107, 108) and one back opening (110) are communicated through a substantially Y-shaped element guide way (150) that is formed inside the slider so as to be branched in the upper-lower direction along the respective guide grooves (103, 104). The element guide way (150) is defined by an inner surface of the upper wing plate (101), an inner surface of the lower wing plate (102), inner sides of the left and right side walls (105, 106) and an element guide pole (120).

With reference to FIGS. 1 and 3, the inner surface of the upper wing plate (101) that defines the element guide way (150) has a slant surface (151) extending downwardly from the upper front opening (108) and a horizontal surface (153) connected to the slant surface (151) on which the element rows are engaged with each other. In addition, the inner surface of the lower wing plate (102) has a slant surface (152) extending upwardly from the lower front opening (108) and a horizontal surface (154) connected to the slant surface (152) on which the element rows are engaged with each other. The back ends of the respective horizontal surfaces (153, 154) are communicated with the back opening (110). The respective connection portions between the slant surfaces (151, 152) and the horizontal surfaces (153, 154) are preferred to be curved for the sake of the smooth motions of the element rows.

The guide grooves (103, 104) may preferably have slant portions and horizontal portions which are formed into the corresponding shapes of the inner surface of the upper wing plate (101) and the inner surface of the lower wing plate (102) and the connection portions are curved for the sake of the smooth motion of the fastener tape. In particular, with reference to FIGS. 1 and 3, the guide groove (104) formed on the left side wall (106) has a front end communicated with the upper front opening (108), a slant portion that is connected to the front end and extends downwardly, a horizontal portion connected to the slant portion, on which the element rows are engaged with each other, and a back end connected to the horizontal portion and communicated with the back opening (110). The slant portion and the horizontal portion are formed parallel to the inner surface of the upper wing plate (101). With reference to FIGS. 1 and 2, the guide groove (103) formed on the right side wall (105) has a front end communicated with the lower front opening (107), a slant portion that is connected to the front end and extends upwardly, a horizontal portion connected to the slant portion, on which the element rows are engaged with each other, and a back end connected to the horizontal portion and communicated with the back opening (110). Then, the slant portion and the horizontal portion are formed parallel to the inner surface of the lower wing plate (102).

When the pair of separated element rows enter the two front openings (107, 108), the element rows initially separated upper side and lower side come gradually close to each other while passing through the element guide way (150) in which one is slanted downwardly and the other is slanted upwardly. Then, on its horizontal portion (153), the element rows are engaged with each other. After that, the pair of fitted element rows are ejected from the shared back opening (110). In this way, when the vertically engaging slider according to the present invention is used, the motion in the upper-lower direction enables the element rows to be engaged with and separated from each other. Thus, the components for spreading the element rows from side to side can be reduced or removed. For this reason, even if the vertically engaging slider is applied to the slide fastener used in the thick cloth such as the leather or the like, the opening/closing operation can be carried out under low slide resistance.

The upper wing plate (101) and the lower wing plate (102) have approximately equal in width in the left-right direction and extend in the front-back direction, and they are substantially rectangular in planer view. In the vertically engaging slider such as the present invention, the element guide way (150) is branched in the upper and lower directions. Thus, it is possible to attain the slider shape which is narrow in width and does not spread in the left and right directions. On the other hand, in a horizontally engaging slider, it is difficult to attain the foregoing shape since the substantially Y-shaped element guide way that is formed inside the slider is branched in the left and right directions. The foregoing shape is advantageous when the slide fastener is sewed on the edge of the cloth, i.e. when the slide fastener is sewed while an interval between the fastener element and the cloth edge is made narrow.

The front end wall (109) has a plastically deformed portion (111) caused by plastic working in which with the front end wall (109) itself as a fulcrum, the back opening (110) is deformed from the open state to the closed state in the upper-lower direction. When the back opening side is opened in the upper-lower direction, it is easy to carry out the die-cast molding. In addition, the slider prior to the plastic working can be die-cast-molded by using the slide cores of front and back two directions. Consequently, the slider according to the present invention can be easily manufactured at a high producing efficiency. In addition, in the slider according to this embodiment, the upper surface of the upper wing plate (101) and the lower surface of the lower wing plate (102) are both flat. Consequently, when the back opening (110) is closed, it becomes easier to apply pressure from the upper and lower directions, which also contributes to the improvement of a dimensional precision.

In the slider according to this embodiment, the plastically deformed portion (111) serves as a partition portion separating the above two front openings (107, 108) of the front end wall (109) in the upper-lower direction. The partition portion exists in the center in the upper-lower direction. Thus, it is adequate to carry out the operation for closing the back opening (110) symmetrically with respect to the upper-lower direction. Thus, when this portion is used as the plastically deformed portion (111), the closing operation is made easy. Hence, in the slider completion product, it is easy to achieve the high dimensional precision.

In the slider according to this embodiment, each of the two front openings (107, 108) exists so as to straddle the central line in the left-right direction. Consequently, there is an overlapping portion in the left-right direction between the two front openings (107, 108). This is explained more concretely with reference to FIG. 1. In the upper front opening (108) which is formed in the front end wall (109) and has the substantially rectangular opening whose left end connected to the left guide groove (104), its right end exceeds the central line in the left-right direction of the slider. On the other hand, in the lower front opening (107) which has the substantially rectangular opening whose right end is connected to the right guide groove (103), its left end exceeds the central line in the left-right direction of the slider. Thus, the overlapping portion between the upper and lower front openings (107, 108) is generated in the left-right direction, which makes the operation for making the element rows engaged with each other smooth. The existence of the overlapping portion in the left-right direction is advantageous from the standpoint of making the width in the left-right direction of the slider narrow. As a result, when the front end wall (109) is observed from the front, the front end wall (109) exhibits an approximate S-shape. Of course, in the case that the upper front opening (108) and the lower front opening (107) are exchanged with respect to the left-right direction, the front end wall may have a substantially inverted S-shape by exchanging the upper front opening (108). This overlapping portion in the left-right direction may preferably have the same width as an overlapping portion between the pair of element rows which are engaged with each other. Consequently, the motions of the respective element rows to the left-right direction are not required. Thus, only the motion in the upper-lower direction can attain the engagement and the separation.

In the slider according to this embodiment, the shape of the opening of each of the two front openings (107, 108) is substantially rectangular, which is intended to correspond to the shape of the element. However, the shape is not particularly limited, and it is possible to employ any shape such as a different polygon, an ellipse, a circle and the like. The circumferences of the above two front openings (107, 108) may be preferably chamfered in order for the element rows to smoothly move in and out.

In the slider according to this embodiment, as can be understood from FIGS. 1, 3 and 4, the plastically deformed portion (111) includes the above overlapping portion between the lower end of the upper front opening (108) and the upper end of the lower front opening (107), and the overlapping portion has the shape of an approximately isosceles triangle pole whose apex is located on the back opening side laying in the left-right direction. This shape of the overlapping portion can guide the element rows to move to and from the inside of the slider smoothly. That is, the plastically deformed portion (111) carries out a function as a so-called element guide pole (112) for branching the element. The element guide pole may be preferably chamfered in order to increase the sliding property of the slider. In particular, the front end side of the approximately isosceles triangle is desired to be set at a rounded state.

The slider according to this embodiment is formed point-symmetrically with respect to a rotation axis that passes through a gravity center of each of the front end and the back end of the slider, except the pull-tab attaching portion (120). Consequently, when the slider is slid, the pair of element rows move symmetrically with respect the upper, lower, right and left directions. Thus, its appearance is beautiful, and the smooth sliding action of the slider can be achieved.

Figure 5:
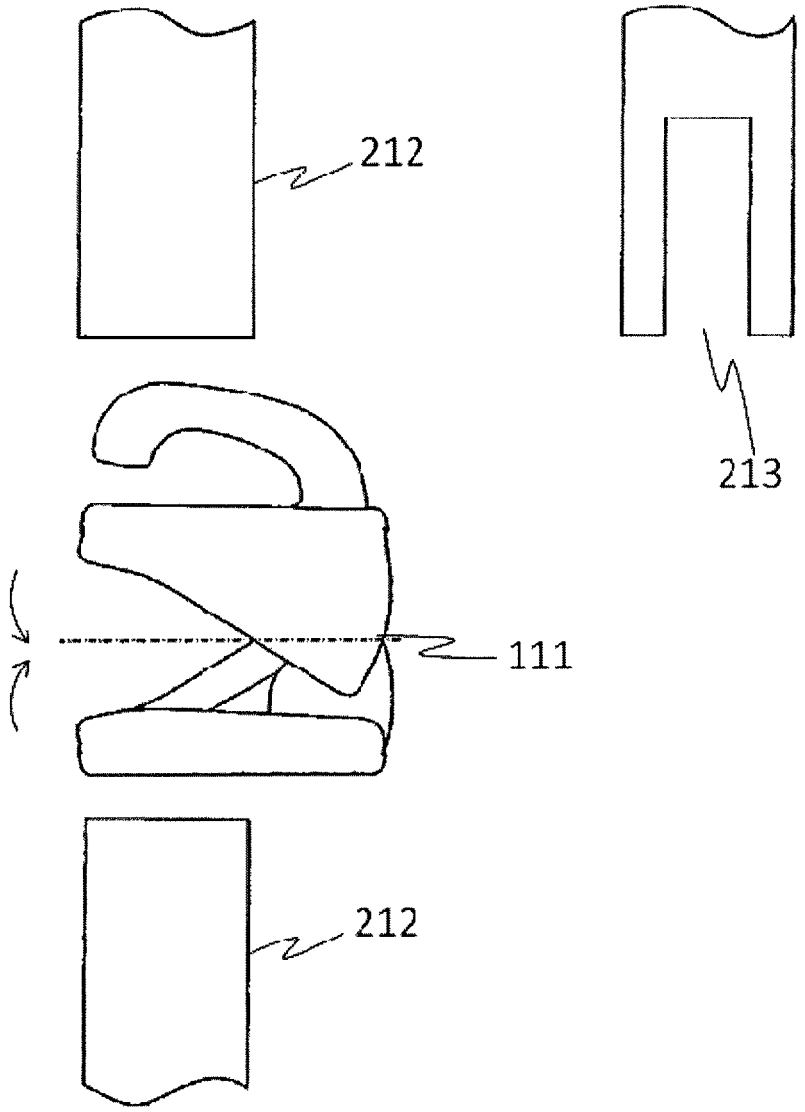
FIG. 5 shows a side view showing the vertically engaging slider shown in FIG. 1 prior to a plastic working with a back opening side vertically opened and also shows one example of a tool used for closing the back opening side.

A method for closing the back opening of the slider will be described below. FIG. 5 shows the side view showing the vertically engaging slider (100) shown in FIG. 1 in which the back opening (110) prior to the plastic working is vertically opened and also shows one example of a tool (212) used when the back opening (110) is closed. An open level of the back opening (110) prior to the plastic working may be properly set by considering moldability and productivity. However, in the case that an open angle is excessively large, a rotation angle when the back opening (110) is closed is made large, which brings about a useless operation and has bad influence on the dimensional precision. On the other hand, in the case that the open angle is excessively small, moldability and productivity are not improved sufficiently. Thus, the open angle of the back opening prior to the plastic deformation may be preferably the angle at which the upper wing plate (101) and the lower wing plate (102) is substantially parallel to each other.

The plastic working for closing the back opening (110) can be carried out by applying pressure to both surfaces of the upper wing plate (101) and the lower wing plate (102) so as to sandwich them from the upper and lower directions. For example, the plastic working for closing the back opening (110) can be carried out by using the tool (212) in which as shown in FIG. 5, the shapes of one ends facing the upper wing plate (101) and the lower wing plate (102) correspond to the shapes of the upper surface of the upper wing plate (101) and the lower surface of the lower wing plate (102), respectively, and then applying pressure, with the central portion in the left-right direction of the front end wall (109) as a rotation axis, so that the back opening (110) is closed. As shown in FIG. 5, the pull-tab attaching portion (120) is formed on the upper surface of the upper wing plate (101). Thus, at the lower end of the tool (212) for pushing the upper wing plate (101), a concave portion (213) for accommodating the pull-tab attaching portion (120) is formed such that the portion of the pull-tab attaching portion (120) does not interfere with the tool (212).

<2. Slide Fastener>

Figure 6:
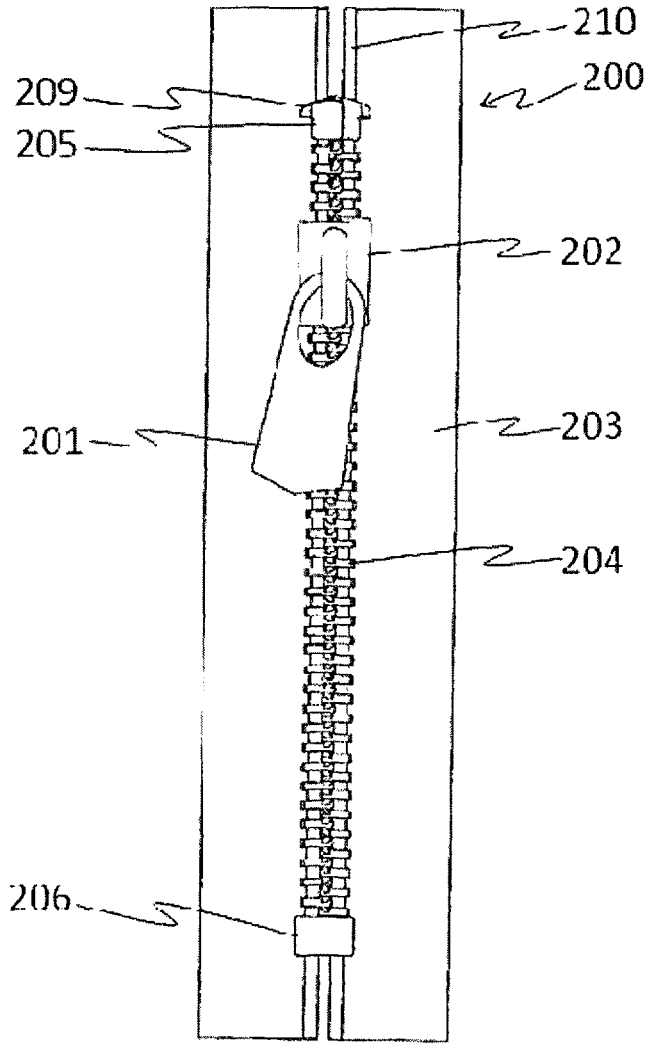
FIG. 6 is a plan view of one example of a slide fastener comprising the vertically engaging slider shown in FIG. 1.
Figure 7:
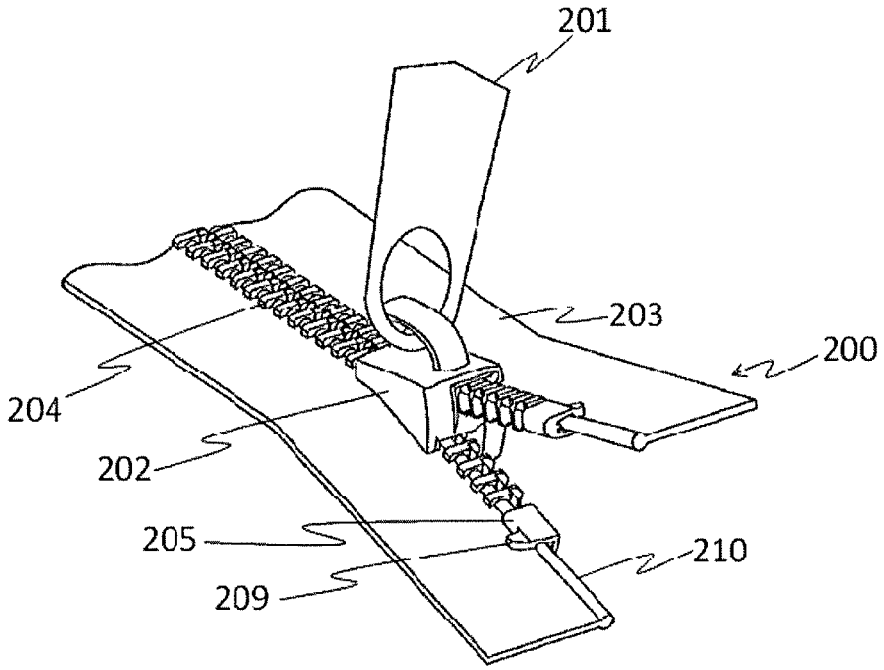
FIG. 7 is a partial perspective view of one example of the slide fastener comprising the vertically engaging slider shown in FIG. 1.
Figure 8:
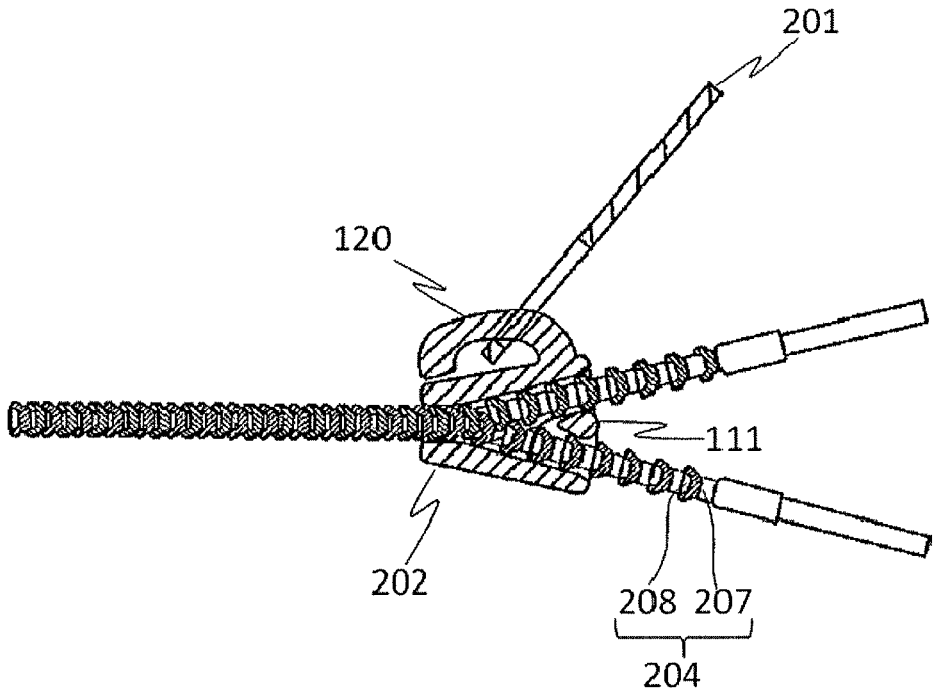
FIG. 8 is a partial cross-sectional view of one example of the slide fastener comprising the vertically engaging slider shown in FIG. 1, which is cut away with respect to the left-right central line.
Figure 9:
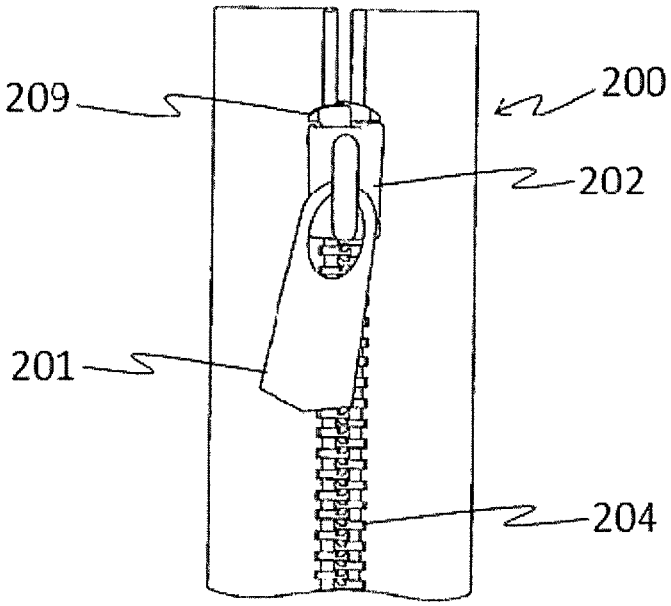
FIG. 9 is a partial plan view showing one example of the slide fastener comprising the vertically engaging slider shown in FIG. 1 with the slider locked by an upper stopper.

One example of the slide fastener containing the vertically engaging slider according to the present invention will be described below. FIG. 6 shows the plan view showing one example of the slide fastener that comprises the vertically engaging slider shown in FIG. 1. FIG. 7 shows the partial perspective view of one example of the slide fastener that comprises the vertically engaging slider shown in FIG. 1. FIG. 8 shows the partial cross-sectional view when one example of the slide fastener that comprises the vertically engaging slider shown in FIG. 1 is cut away with respect to the left-right central line. FIG. 9 shows the partial plan view showing the situation in which for one example of the slide fastener comprising the vertically engaging slider shown in FIG. 1, the slider is locked by the upper stopper.

With reference to FIG. 6, a slide fastener (200) comprising the vertically engaging slider consists of a vertically engaging slider (202), fastener tapes (203), rows of fastener elements (204), an upper stopper (205) placed on the front portion, and a lower stopper (206) placed on the back portion. The fastener tapes (203) are configured as a pair, and a stringer in a situation in which the row of the fastener elements (204) is attached to each of the fastener tapes (203) is referred to as a fastener stringer. A chain in which the respective fastener stringers are configured as a pair is referred to as a fastener chain.

The slider (202) can make the rows of the fastener elements (204) to engaged with or separated from each other by sliding the rows of the fastener elements (204) with the rows of the fastener elements inserted into the slider. A pull-tab (201) is attached to the pull-tab attaching portion (120) of the slider (202). Each of the fastener tapes (203) is woven or knitted by using synthetic fiber or natural fiber. Two core threads (210) adjacent to each other are woven or knitted along the edge in its longitudinal direction. The fastener element row composed of the plurality of fastener elements (204) that can be engaged with or separated from each other by the slider (202) is attached to the core thread (210). The type of the fastener element (204) is not limited. For example, the fastener element (204) having the shape in which a convex portion (207) is formed in the front portion and a concave portion (208) is formed in the back portion can be provided as shown in FIG. 8. In this case, as can be understood from FIGS. 7 and 8, in association with the forwardly sliding action of the slider (202), the respective element rows, which come from the front openings (107, 108) and come close to each other from the upper and lower directions, are gradually engaged with each other in the front-back portion with the use of the concave and convex portion, and ejected in the fitted state from the back opening (110).

The upper stopper (205) is a part for preventing the slider from being fallen forwardly, and the upper stopper (205) is arranged at the front end of each of the rows of the fastener elements (204) and can be fixed to the edge of the fastener tape by caulking or injection molding. The configuration of the upper stopper (205) is not particularly limited. In this embodiment, the upper stopper (205) is configured to have the front portion having protrusions (209) that can be brought into contact with the circumferences of the front openings (107, 108) of the slider, and a back portion that is inserted into the element guide way (150) from the front openings (107, 108) of the slider. As can be understood from FIGS. 8 and 9, the back portion of the substantially rectangular shape in planner view of the upper stopper (205) that corresponds the shape of each of the front openings (107, 108) is inserted into the element guide way (150), and the protrusion (209) of the front portion is brought into contact with the circumference (a part of the front edge wall) of each of the front openings (107, 108) of the slider so that the forwardly sliding action of the slider is consequently stopped.

Figure 10:
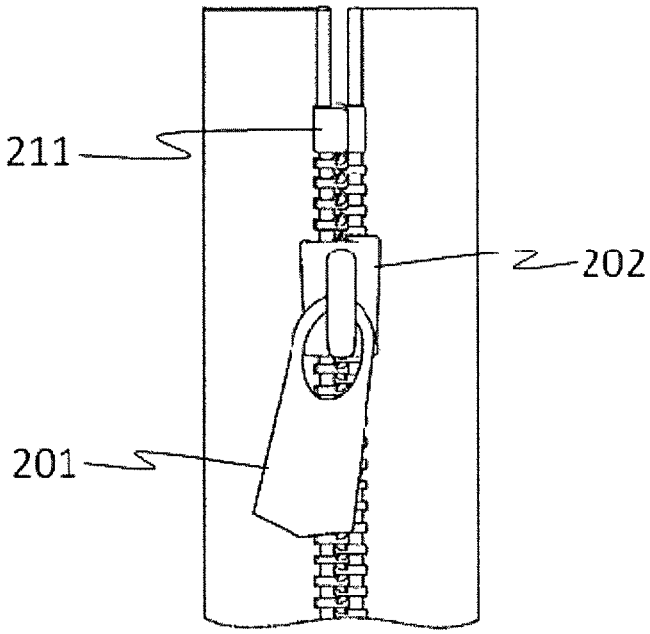
FIG. 10 is a partial plan view of another example of the slide fastener comprising the vertically engaging slider shown in FIG. 1.
Figure 11:
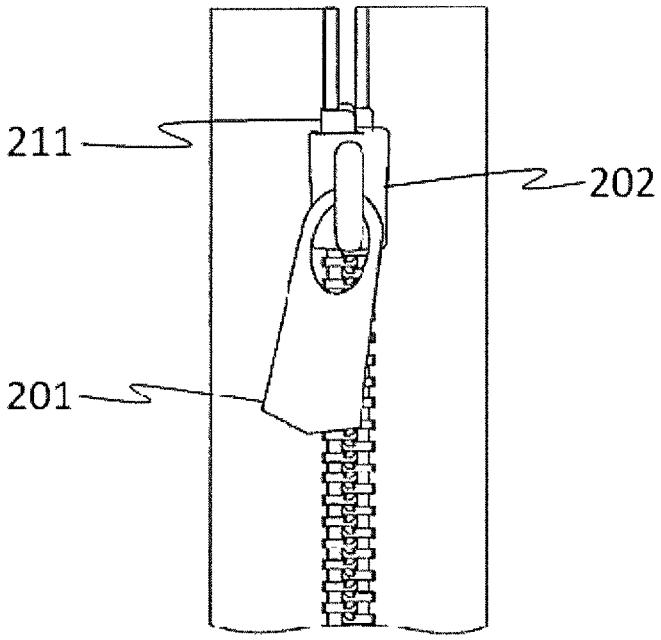
FIG. 11 is a partial plan view showing another example of the slide fastener comprising the vertically engaging slider shown in FIG. 1 with the slider locked by the upper stopper.

The protrusion (209) of the front portion may not be necessary. For example, as shown in FIGS. 10 and 11, a part or whole of upper stoppers (211) is inserted into the element guide way (150) from the back, and the left and right upper stoppers (211) consequently interfere with each other, which can stop the slider from being slid forwardly. In a case that the upper stoppers (205) each of which does not have the protrusion (209) in the front portion are used, FIG. 10 shows the situation before the slider is locked by the upper stopper (205)

and FIG. 11 shows the situation in which the slider is locked, respectively. The back portion of the upper stopper (211) whose shape is substantially rectangular in planar view and corresponds to the shapes of the front openings (107, 108) is inserted into the element guide way (150) and then, they interfere with each other inside the slider. Consequently, the forwardly sliding action of the slider is stopped.

The lower stopper (206) is placed at the back end of the row of the fastener elements (204). Since the lower stopper (206) is brought into contact with the circumference (a part of the front end wall) of the back opening (110) of the slider (202), the slider (202) is prevented from being fallen backwardly. The method for attaching the lower stopper (206) and its shape are not particularly limited. In this embodiment, the lower stopper (206), which is substantially rectangular in planar view, is caulked and fixed to both side ends opposite to the respective fastener stringers. The lower stopper (206) according to this embodiment is configured so as to disable the back end of the fastener chain to be separated. However, a separation insertion tool that can separate each fastener string may be attached.

As mentioned above, the present invention has been described on the basis of the embodiment. However, the present invention is not limited to the embodiment, and various variations can be carried out.

DESCRIPTION OF SYMBOLS

100 slider
101 upper wing plate
102 lower wing plate
103, 104 guide groove
105, 106 side wall
107, 108 front opening
109 front end wall
110 back opening
111 plastically deformed portion
112 element guide way pole
120 pull-tab attaching portion
150 element guide way
151 slant surface of upper wing plate
152 slant surface of lower wing plate
153 horizontal surface of upper wing plate
154 horizontal surface of lower wing plate
200 slide fastener
201 pull-tab
202 slider
203 fastener tape
204 fastener element
205, 211 upper stopper
206 lower stopper
207 concave portion of element
208 convex portion of element
209 protrusion
210 core thread
212 pushing tool
213 concave portion of tool

The invention claimed is:

1. A metallic slider for a slide fastener, comprising:
an upper wing plate;
a lower wing plate;
a front end wall connecting the upper wing plate and the lower wing plate and having two front openings which are formed in different heights in an upper-lower direction and through which a pair of separated element rows are to be moved in and out;
a back opening through which a pair of engaged element rows are moved in and out; and
an element guide way which is arranged between the upper wing plate and the lower wing plate and communicates the two front openings with the back opening,
wherein the front end wall has a plastically deformed portion caused by plastic working in which with the front end wall itself as a fulcrum, the back opening is deformed from an open state to a closed state in the upper-lower direction.

2. The slider according to claim 1,
wherein an inner surface of the upper wing plate has a slant surface extending downwardly from the upper front opening and a horizontal surface on which the element rows are to be engaged with each other, the horizontal surface being connected to the downward slant surface,
an inner surface of the lower wing plate has a slant surface extending upwardly from the lower front opening and a horizontal surface on which the element rows are to be engaged with each other, the horizontal surface being connected to the slant surface, and
back ends of the respective horizontal surfaces are communicated with the back opening.

3. The slider according to claim 2, which comprises left and right side walls having guide grooves for fastener tapes, respectively, wherein slant portions and horizontal portions that correspond to the shapes of the inner surface of the upper wing plate and the inner surface of the lower wing plate are formed in the guide grooves.

4. The slider according to claim 1, wherein the plastically deformed portion is a partition portion for separating said two front openings to the upper and lower directions in the front end wall.

5. The slider according to claim 1,
wherein each of said two front openings exists so as to straddle a central line in a left-right direction, and whereby said two front openings have an overlapping portion in the left-right direction.

6. The slider according to claim 1, wherein in said overlapping portion between a lower end of the upper front opening and an upper end of the lower front opening, an element guide pole, which has a shape of an approximately isosceles triangle pole having its apex on a back opening side, is formed so as to lay in the left-right direction.

7. The slider according to claim 1, wherein said plastic working is carried out by applying pressure to both outer surfaces of the upper wing plate and the lower wing plate so as to sandwich them.

8. The slider according to claim 1, wherein the outer surfaces of the upper wing plate and the lower wing plate are both flat except pull-tab attaching portion.

9. A slide fastener comprising: a pair of fastener stringers each of which has a fastener tape and a row of elements attached along one side edge of the tape; and the slider according to claim 1, for making the rows of said elements engaged with or separated from each other by sliding while inserting through the rows of said elements.

10. The slide fastener according to claim 9, comprising upper stoppers each of which is placed at a front end of each of the rows of the fastener elements, wherein a part or whole of the upper stoppers is inserted into the element guide way from the back.

11. The slide fastener according to claim 9, comprising upper stoppers that has a front portion having protrusion which can be brought into contact with circumferences of the front openings, and a back portion which is inserted into the element guide way from the front openings.

* * * * *

UNITED STATES PATENT AND TRADEMARK OFFICE

CERTIFICATE OF CORRECTION

PATENT NO. : 9,185,951 B2
APPLICATION NO. : 14/112309
DATED : November 17, 2015
INVENTOR(S) : Keiichi Keyaki et al.

It is certified that error appears in the above-identified patent and that said Letters Patent is hereby corrected as shown below:

IN THE SPECIFICATION

In column 4, line 24, delete “narrow” and insert -- narrow. --, therefor.

In column 6, line 11, delete “line” and insert -- line. --, therefor.

Signed and Sealed this
Sixteenth Day of February, 2016

Michelle K. Lee

Michelle K. Lee
*Director of the United States Patent and Trademark Office*